US006717343B2

(12) United States Patent
Kim et al.

(10) Patent No.: US 6,717,343 B2
(45) Date of Patent: Apr. 6, 2004

(54) COLOR SELECTION APPARATUS FOR CATHODE RAY TUBE

(75) Inventors: Dong Hwan Kim, Suwon (KR); Joon Suk Park, Kunpo (KR)

(73) Assignee: Samsung SDI Co., Ltd., Suwon (KR)

( * ) Notice: Subject to any disclaimer, the term of this patent is extended or adjusted under 35 U.S.C. 154(b) by 52 days.

(21) Appl. No.: 09/999,597

(22) Filed: Nov. 15, 2001

(65) Prior Publication Data

US 2002/0105256 A1 Aug. 8, 2002

(30) Foreign Application Priority Data

Dec. 8, 2000 (KR) ..... 2000-74760

(51) Int. Cl.[7] ..... H01J 29/80
(52) U.S. Cl. ..... 313/402; 313/407
(58) Field of Search ..... 313/402, 407

(56) References Cited

U.S. PATENT DOCUMENTS 4,725,756 A 2/1988 Kaplan ..... 313/407
5,488,263 A * 1/1996 Takemura et al. ..... 313/402
5,592,044 A * 1/1997 Ohtake et al. ..... 313/402
5,664,192 A 9/1997 Lloyd et al. ..... 395/672

OTHER PUBLICATIONS

Tanaka et al. JP 2000—14189, Jan. 20, 2000.*

* cited by examiner

*Primary Examiner*—Nimeshkumar D. Patel
*Assistant Examiner*—Sharlene Leurig
(74) *Attorney, Agent, or Firm*—Christie, Parker & Hale, LLP

(57) ABSTRACT

A color selection apparatus for a cathode ray tube, having a frame formed with a pair of supporting members arranged facing each other at a predetermined distance therebetween and a pair of elastic members coupled to the supporting members; and a mask formed with a plurality of slits for passing electron beams and fixed to the supporting members under tension. Each of the elastic members is formed with a pair of opposite parts facing each other in parallel at a predetermined distance therebetween, and a connection part perpendicularly arranged between the opposite parts. The opposite parts are preferably opposite each other in a direction where the electron beams advance (z-axis direction of the cathode ray tube). Alternatively, the opposite parts are opposite each other in a major direction of the mask (x-axis direction of the cathode ray tube).

14 Claims, 5 Drawing Sheets

COLOR SELECTION APPARATUS FOR CATHODE RAY TUBE

CROSS REFERENCE TO RELATED APPLICATION

This application claims priority of Korean patent Application No. 2000-74760 filed in the Korean Industrial Property Office on Dec. 8, 2000, the entire contents of which are incorporated herein by reference.

FIELD OF THE INVENTION

The present invention relates to a color selection apparatus for a cathode ray tube, and more particularly, to a color selection apparatus capable of reducing the weight of a frame by improving the structure of a pair of elastic members.

BACKGROUND OF THE INVENTION

A cathode ray tube (CRT) is a device for displaying images on a screen by emitting three electron beams from an electron gun and landing the electron beams onto a phosphor screen. The electron beams are divided onto corresponding red R, green G, and blue B phosphor layers respectively through a color selection apparatus, which is mounted in front of the phosphor screen.

FIG. 1 is a perspective view of a prior art color selection apparatus. The color section apparatus 1 includes a mask 3 formed with a plurality of slits 3*a* for passing electron beams, and a frame 5 supporting the mask 3, wherein the frame 5 is formed with a pair of supporting members 7 fixing the mask 3, and a pair of elastic members 9 connecting the supporting members 7.

Generally, the mask 3 is tensed in a minor axial direction (y-axis direction in the drawing), and the long sides of the mask 3 are fixed to the supporting members 7 by a well-known spot welding method. During the assembly of the color selection apparatus 1, the elastic members 9 are deformed elastically by the tension toward the center of the mask 3, so that the force of restitution of the elastic members 9 supports the tension of the mask 3.

FIG. 2 is a sectional view taken along line I—I of FIG. 1. The elastic members 9 are formed as a hollow pipe having a square cross section as shown in FIG. 2.

In connection with the function of the frame that is supporting the tension of the mask, U.S. Pat. Nos. 4,725,756 and 5,644,192 disclose various structures of the color selection apparatus to improve the strength of the frame. However, the prior art provides either an additional member attached to the frame, or more heavy elastic members, for supporting the increasing tension applied to the mask.

Accordingly, the structure and manufacturing process of the color selection apparatus becomes complicated. Moreover, the color selection apparatus becomes enlarged as the screen is enlarged, thereby increasing the weight of the color selection apparatus.

Such an increase of the weight of the color selection apparatus makes it difficult to attach the color selection apparatus onto a face panel and to detach the color selection apparatus from the face panel when manufacturing the phosphor screen. As a result, the manufacturing yield of the phosphor screen is reduced.

Also, in elastic members 9 having a square cross section as described above, the gas generated when welding the elastic members 9 and the supporting members 7 remains within the elastic members 9. This is disadvantageous because the manufacturing process of the color selection apparatus becomes complicated. For example, a hole should be formed on the elastic members 9 to remove the residual gas.

SUMMARY OF THE INVENTION

It is an object of the present invention to provide a color selection apparatus for a cathode ray tube in which the weight of a frame may be effectively reduced.

It is another object of the present invention to provide a color selection apparatus for a cathode ray tube capable of preventing gas generated when welding the elastic members and the supporting members from remaining within the elastic members.

In order to achieve the above objects of the present invention, a color selection apparatus includes a frame formed with a pair of supporting members arranged facing each other with a predetermined distance therebetween, a pair of elastic members coupled to the supporting members, and a mask formed with a plurality of slits for passing electron beams and fixed at the supporting members under tension. Each of the elastic members is formed with a pair of opposite parts facing each other in parallel at a predetermined distance therebetween and a connection part is perpendicularly arranged between the opposite parts.

Preferably, the elastic member is formed with a pair of opposite parts facing each other in a direction where the electron beams advance, and the connection part is perpendicularly arranged between the opposite parts.

Alternatively, the elastic member is formed with a pair of opposite parts facing each other in a major direction of the mask, and the connection part is perpendicularly arranged between the opposite parts.

Preferably, the elastic member is formed to maintain a secondary moment of inertia $M_2$ at a level higher than 85% of $M_1$, wherein $M_1$ is a secondary moment of inertia of an elastic member which is formed is a hollow pipe having a square cross section and designed under the same tension.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings wherein.

DETAILED DESCRIPTION OF THE PREFERRED EMBODIMENTS

A preferred embodiment of this invention will be explained with reference to the accompanying drawings.

Figure 3:
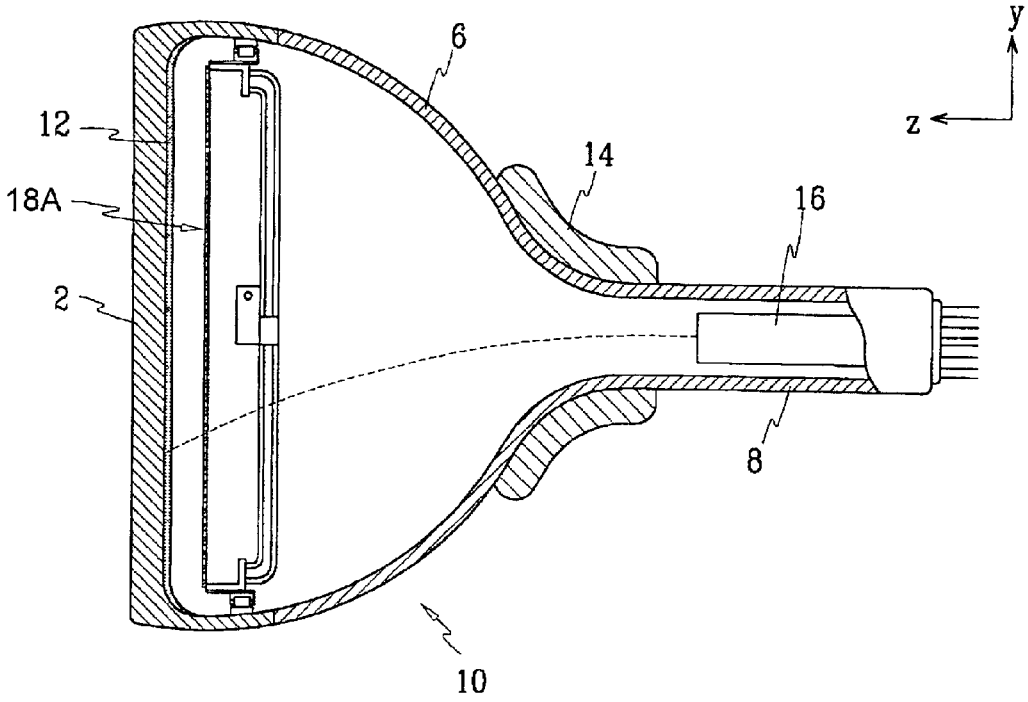
FIG. 3 is a sectional view of a cathode ray tube including a color selection apparatus according to a first embodiment of the present invention.

FIG. 3 is a sectional view of a cathode ray tube including a color selection apparatus according to a first embodiment of the present invention. As shown in FIG. 3, a cathode ray tube includes a vacuum tube 10 which is formed with a face panel 2 having a phosphor screen 12, a neck portion 8 in which an electron gun assembly 16 is arranged, and a funnel 6 placed between the face panel 2 and the neck portion 8. A deflection yoke 14 is mounted on an outer periphery of the funnel 6. Preferably, the face panel 2 has a substantially flat outer surface.

A color selection apparatus 18A is fixedly installed inside of the face panel 2 and divides three rays of electron beams emitted from the electron gun assembly 16 onto corresponding phosphor layers of the phosphor screen 12. That is, when the electron gun assembly 16 emits three electron beams, the electron beams are deflected by a magnetic field generated by the deflection yoke 14 and divided onto corresponding R, G and B phosphor layers of the phosphor screen 12, so that accurate colors are realized.

Figure 4:
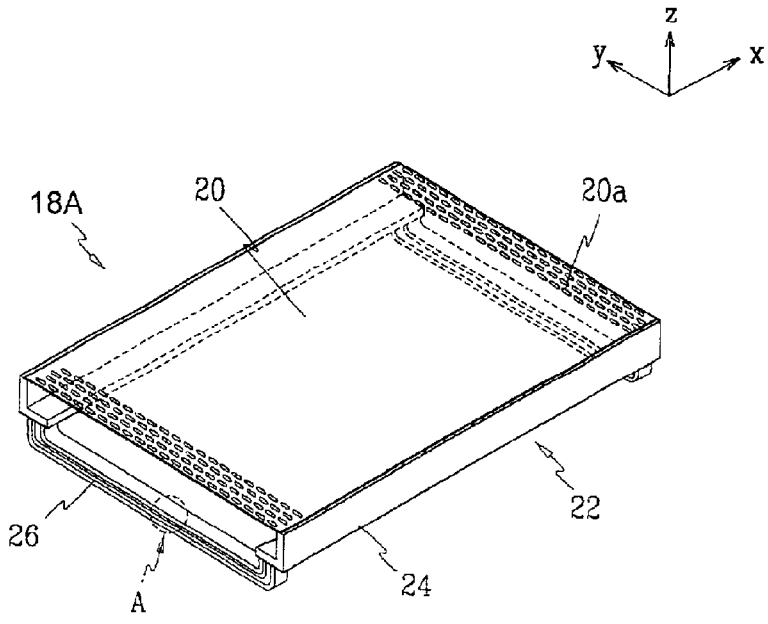
FIG. 4 is a perspective view of the color selection apparatus according to the first embodiment of the present invention.
Figure 5:
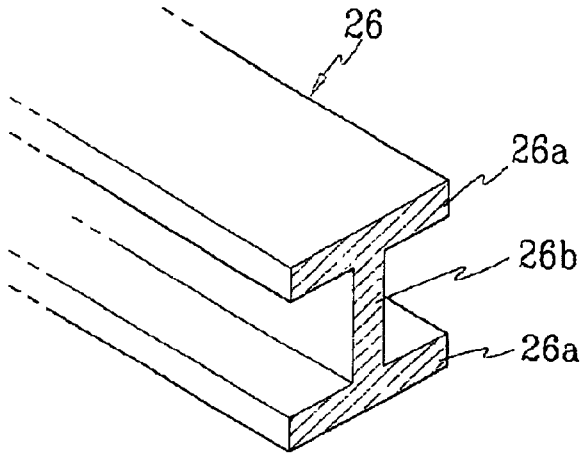
FIG. 5 is an enlarged view of part A shown in FIG. 4.

FIG. 4 is a perspective view of the color selection apparatus according to the first embodiment of the present invention, and FIG. 5 is an enlarged view of part A shown in FIG. 4. As shown in FIGS. 4 and 5, the color selection apparatus 18A according to a first embodiment of the present invention, includes a mask 20 having a plurality of slits 20*a* for passing electron beams and a frame 22 for fixing and supporting the mask 20. The frame 22 includes a pair of supporting members 24 facing toward the long sides of the mask 20, and a pair of elastic members 26 integrally coupled to the supporting members 24.

The mask 20 is mounted to the frame 22 after forming the slits 20*a*, by welding a pair of long sides of the supporting members 24 in a state where a predetermined tension is applied in a minor axial direction (y-axis direction in the drawing). A pair of elastic members 26 support the tension of the mask 20 to prevent the supporting members 24 from bending toward the inside of the mask 20.

The color selection apparatus 18A according to the first embodiment of the present invention provides that the elastic members 26 are able to effectively reduce the weight of the frame 22 while maintaining strength similar to the elastic members according to the prior art.

Each elastic member 26 includes a pair of opposite parts 26*a* facing each other with a predetermined distance therebetween in a direction where the electron beams advance (z-axis direction in the drawing). A connection part 26*b* is perpendicularly arranged between the opposite parts 26*a*, so that the section of the elastic member 26 is formed in an I-shape over its own longitudinal direction (y-axis direction in the drawing).

Figure 6:
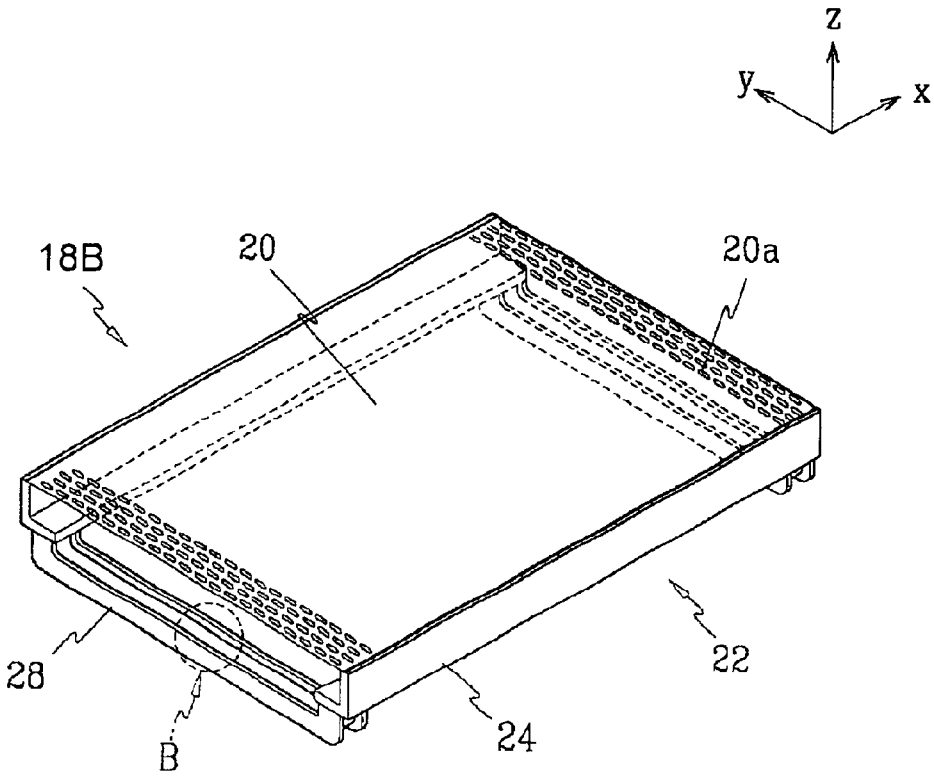
FIG. 6 is a perspective view of a color selection apparatus according to a second embodiment of the present invention.
Figure 7:
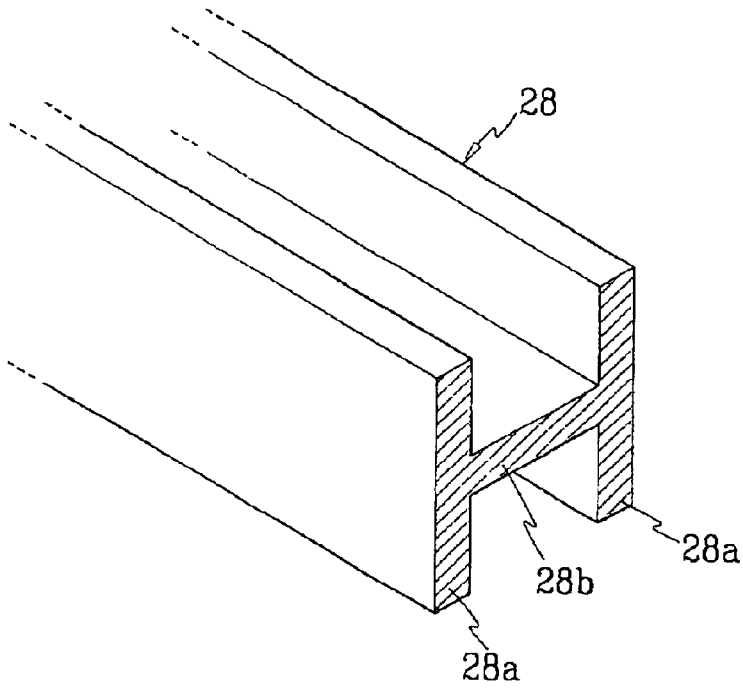
FIG. 7 is an enlarged view of part B shown in FIG. 6.

FIG. 6 is a perspective view of a color selection apparatus according to a second embodiment of the present invention, and FIG. 7 is an enlarged view of part B shown in FIG. 6. In the color selection apparatus 18B as shown in FIGS. 6 and 7, each elastic member 28 includes a pair of opposite parts 28*a* facing each other at a predetermined distance therebetween in a major direction of the mask 20 (x-axis direction in the drawing). A connection part 28*b* is perpendicularly arranged between the opposite parts 28*a*, so that the section of the elastic member 28 is formed in an H-shape over own longitudinal direction (y-axis direction in the drawing).

When the elastic members 26 and 28 having the I-shaped or H-shaped sectional structure are appropriately defined within a range not much different in thickness and size characteristics (for example, horizontal and vertical lengths) than the elastic members according to the prior art, the section area of the elastic members 26 and 28 is decreased in comparison with the sectional area of the elastic members according to the prior art. Accordingly, the elastic members 26 and 28 effectively reduce the weight of the frame 22 by reducing the sectional area, if the elastic members 26 and 28 are formed with materials equivalent to the elastic members of the prior art.

Also, it is important to maintain a secondary moment of inertia of the elastic members 26 and 28 at a level higher than a predetermined value to satisfy the strength characteristics required for the frame 22.

Figure 1:
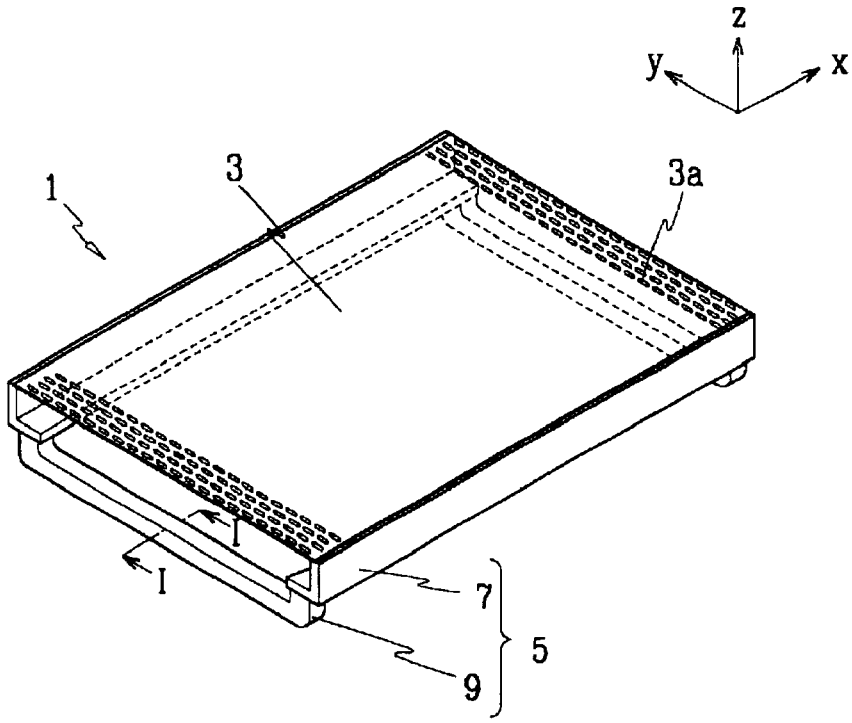
FIG. 1 (Prior Art)
FIG. 1 is a perspective view of a color selection apparatus according to the prior art.
Figure 2:
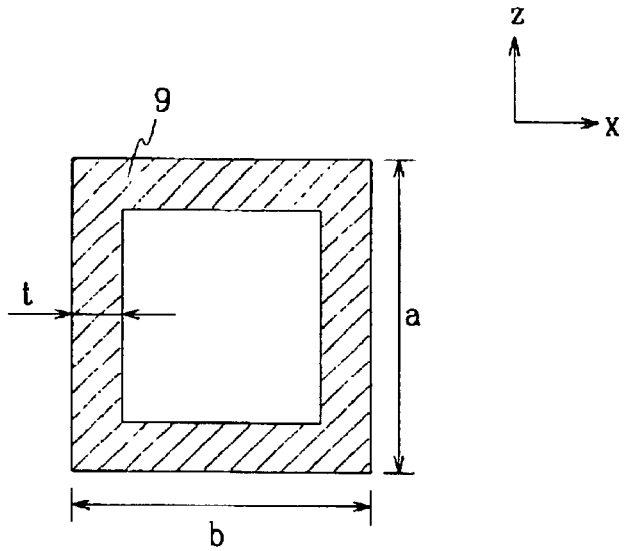
FIG. 2 (Prior Art)
FIG. 2 is a sectional view of a prior art elastic member taken along line I—I of FIG. 1.

Preferably, if the secondary moment of inertia $M_1$ of the elastic members according to the prior art (which are formed as a hollow pipe having a square cross section as shown in FIG. 2) designed under the same tension is assumed as 100, then the elastic members 26 and 28 according to the first and second embodiments are formed to maintain a secondary moment of inertia $M_2$ at a level higher than 85% of $M_1$. Hereby, the elastic members 26 and 28 have an advantage of reducing the weight of the frame 22 while minimizing the degradation of the strength characteristics generated by reducing the sectional area and the weight.

Figure 8:
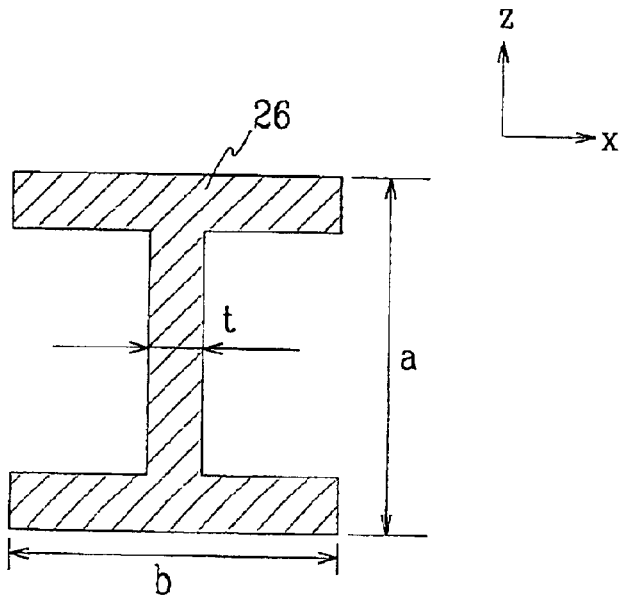
FIG. 8 is a sectional view of an elastic member according to the first embodiment of the present invention.
Figure 9:
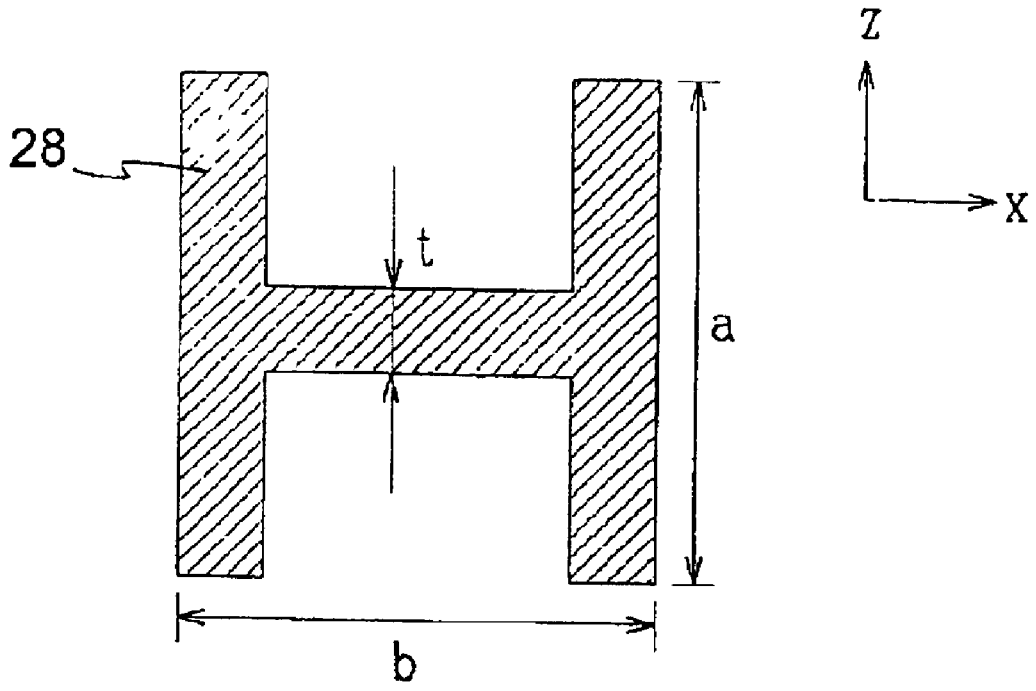
FIG. 9 is a sectional view of an elastic member according to the second embodiment of the present invention.

FIGS. 8 and 9 are sectional views of elastic members according to the first and second embodiments of the present invention respectively, and FIG. 2 is a cross-sectional view of elastic members according to the prior art. Sectional areas $A_1$, $A_2$ and $A_3$ of each of the elastic members 26, 28 and 9 respectively, based on the vertical length a, horizontal length b, and thickness t shown in the drawings, are represented by the following formulas 1 to 3.

$$A_1=ab-(a-2t)(b-t) \quad \text{[Formula 1]}$$

$$A_2=ab-(a-t)(b-2t) \quad \text{[Formula 2]}$$

$$A_3=ab-(a-2t)(b-2t) \quad \text{[Formula 3]}$$

Secondary moments of inertia $Ix_1$, $Ix_2$ and $Ix_3$ of each of the elastic members 26 and 28 according to the first and second embodiments of the present invention, and of the elastic members 9 according to the prior art respectively, are represented by the following formulas 4 to 6.

$$Ix_1 = \frac{1}{12}[ba^3-(b-t)(a-2t)^3] \quad \text{[Formula 4]}$$

$$Ix_2 = \frac{1}{12}[2ta^3+(b-2t)t^3] \quad \text{[Formula 5]}$$

$$Ix_3 = \frac{1}{12}[ba^3-(b-2t)(a-2t)^3] \quad \text{[Formula 6]}$$

For example, the size characteristics of the elastic members 26 and 28 according to the present invention and the elastic members 9 according to the prior art are represented in the following table 1. Based on the above formulas and table 1, table 2 represents the sectional area, weight, and weight ratio, etc., where all of the elastic members are formed with materials having a density of $7.6\times10^{-6}$ kg/mm$^3$.

TABLE 1

| | First embodiment | Second embodiment | Prior Art |
|---|---|---|---|
| a (mm) | 30 | 35 | 30 |
| b (mm) | 30 | 30 | 30 |
| t (mm) | 2.5 | 2.5 | 2.5 |

TABLE 2

| | First embodiment | Second embodiment | Prior Art |
|---|---|---|---|
| Sectional area ($mm^2$) | 212.5 | 225 | 275 |
| Length (mm) | 500 | 500 | 500 |
| Weight (kg) | 0.8075 | 0.855 | 1.045 |
| Weight ratio (%) | 77.3 | 81.8 | 100 |
| Secondary moment of inertia ($mm^4$) | 31,692.71 | 45,312.5 | 34,947.92 |
| Secondary moment of inertia ratio (%) | 90.68 | 129.0 | 100 |

As shown in the above tables, the elastic members 26 and 28 according to the present invention show weight ratios of 77.3% and 81.8% respectively, in comparison with elastic members 9 according to the prior art having the same length. Thereby, it will be appreciated that the weight of the frame 22 is effectively reduced.

Since the elastic members 26 and 28 according to the present invention show secondary moment of inertia ratios 90.69% and 129.0% respectively in comparison with the elastic members 9 according to the prior art, the elastic members 26 and 28 satisfy the required strength characteristics of the frame 22. Moreover, the elastic members 28 according to the second embodiment of the present invention improve the strength characteristics of the frame 22 in comparison with the prior art, in spite of reducing the weight.

Therefore, the color selection apparatus 18A and 18B of the present invention satisfies the strength required for the frame 22 while effectively reducing the weight of the frame 22 by reducing sectional areas of the elastic members 26 and 28.

Also, in the structure of the above elastic members, gas generated when welding the elastic members and the supporting members, is easily exhausted outside of the elastic members, instead of remaining inside of the elastic members, so that a previously required process for forming an additional hole in the elastic members may be omitted.

While the present invention has been described with reference to preferred embodiments, these skilled in the art will appreciate that various modifications and substitutions can be made without departing from the spirit and scope of the present invention as set forth in the appended claims.

What is claimed is:

1. A color selection apparatus for a cathode ray tube, comprising:

a frame formed with a pair of supporting members arranged facing each other with a predetermined distance therebetween and a pair of elastic members coupled to the supporting members; and a mask formed with a plurality of slits for passing electron beams and fixed to the supporting members under tension, wherein each of the elastic members is formed with a pair of opposite parts facing each other in parallel with a predetermined distance therebetween, each of the opposite parts having two edges, and a connection part perpendicularly arranged between the opposite parts and connected between the two edges on each of the opposite parts.

2. The color selection apparatus of claim 1 wherein the opposite parts face each other in a direction in which electron beams advance.

3. The color selection apparatus of claim 2 wherein a cross-section of the elastic member has a vertical length (a), a horizontal length (b) and the connection part has a thickness (t), wherein said elastic member is formed to maintain a secondary moment of inertia $M_2$ at a level higher than 85% of another secondary moment of inertia $M_1$, the $M_1$ being said another secondary moment of inertia of another elastic member which is formed as a square hollow pipe having another cross-section having the vertical length (a), the horizontal length (b) and at least a pair of opposite parts each having the thickness (t); the $M_1$ and $M_2$ being represented by the following formulas:

$$M_1 = \frac{1}{12}[ba^3 - (b-2t)(a-2t)^3];$$

and $$M_2 = \frac{1}{12}[ba^3 - (b-t)(a-2t)^3].$$

4. The color selection apparatus of claim 1 wherein the mask has a major direction and a minor direction; and wherein the opposite parts face each other in the major direction of the mask.

5. The color selection apparatus of claim 4 wherein a cross-section of the elastic member has a vertical length (a), a horizontal length (b) and the connection part has a thickness (t), wherein said elastic member is formed to maintain a secondary moment of inertia $M_2$ at a level higher than 85% of another secondary moment of inertia $M_1$, the $M_1$ being said another secondary moment of inertia of another elastic member which is formed as a square hollow pipe having another cross-section having the vertical length (a), the horizontal length (b) and at least a pair of opposite parts each having the thickness (t); the $M_1$ and $M_2$ being represented by the following formulas:

$$M_1 = \frac{1}{12}[ba^3 - (b-2t)(a-2t)^3];$$

and $$M_2 = \frac{1}{12}[2ta^3 + (b-2t)t^3].$$

6. A cathode ray tube, comprising:

a face panel on which a phosphor screen is formed;

a neck portion in which an electron gun assembly is arranged, the electron gun emitting three electron beams toward the phosphor screen;

a funnel placed between the face panel and the neck portion;

a deflection yoke mounted at an outer periphery of the funnel for deflecting the electron beams emitted from the electron gun; and a color selection apparatus fixedly installed inside the face panel for dividing the three electron beams onto a corresponding red R, green G, and blue B phosphor layers of the phosphor screen, the color selection apparatus comprising:

a frame formed with a pair of supporting members arranged facing each other with a predetermined distance therebetween and a pair of elastic members coupled to the supporting members; and a mask formed with a plurality of slits for passing electron beams and fixed to the supporting members under tension;

wherein each of the elastic members is formed with a pair of opposite parts facing each other in parallel with a predetermined distance therebetween, each of the opposite parts having two edges, and a connection part perpendicularly arranged between the opposite parts and connected between the two edges on each of the opposite parts.

7. The cathode ray tube of claim 6 wherein the opposite parts face each other in a direction in which the electron beams advance.

8. The cathode ray tube of claim 7 wherein a cross-section of the elastic member has a vertical length (a), a horizontal length (b) and the connection part has a thickness (t), wherein said elastic member is formed to maintain a secondary moment of inertia $M_2$ at a level higher than 85% of another secondary moment of inertia $M_1$, the $M_1$ being said another secondary moment of inertia of another elastic member which is formed as a square hollow pipe having another cross-section having the vertical length (a), the horizontal length (b) and at least a pair of opposite parts each having the thickness (t); the $M_1$ and $M_2$ being represented by the following formulas:

$$M_1 = \frac{1}{12}[ba^3 - (b-2t)(a-2t)^3];$$

and $$M_2 = \frac{1}{12}[ba^3 - (b-t)(a-2t)^3].$$

9. The cathode ray tube of claim 6 wherein the mask has a major direction and a minor direction; and wherein the opposite parts face each other in a major direction of the mask.

10. The cathode ray tube of claim 9 wherein a cross-section of the elastic member has a vertical length (a), a horizontal length (b) and the connection part has a thickness (t), wherein said elastic member is formed to maintain a secondary moment of inertia $M_2$ at a level higher than 85% of another secondary moment of inertia $M_1$, the $M_1$ being said another secondary moment of inertia of another elastic member which is formed as a square hollow pipe having another cross-section having the vertical length (a), the horizontal length (b) and at least a pair of opposite parts each having the thickness (t); the $M_1$ and $M_2$ being represented by the following formulas:

$$M_1 = \frac{1}{12}[ba^3 - (b-2t)(a-2t)^3];$$

and $$M_2 = \frac{1}{12}[2ta^3 + (b-2t)t^3].$$

11. The color selection apparatus of claim 1, wherein each of the elastic members has a generally H-shaped cross-section.

12. The color selection apparatus of claim 1, wherein each of the elastic members has a generally I-shaped cross-section.

13. The cathode ray tube of claim 6, wherein each of the elastic members has a generally H-shaped cross-section.

14. The cathode ray tube of claim 6, wherein each of the elastic members has a generally I-shaped cross-section.

* * * * *